United States Patent [19]

Jaeger

[11] Patent Number: 5,062,471

[45] Date of Patent: Nov. 5, 1991

[54] HEAT TRANSFER SYSTEM WITHOUT MASS TRANSFER

[75] Inventor: Marc J. Jaeger, Gainesville, Fla.

[73] Assignee: University of Florida, Gainesville, Fla.

[21] Appl. No.: 630,201

[22] Filed: Dec. 19, 1990

Related U.S. Application Data

[62] Division of Ser. No. 397,407, Aug. 23, 1989, Pat. No. 5,004,041, which is a division of Ser. No. 199,355, May 26, 1988, Pat. No. 4,880,049.

[51] Int. Cl.[5] ..... F32D 19/04

[52] U.S. Cl. ..... 165/8; 165/10; 165/86

[58] Field of Search ..... 165/6, 10, 86, 8

[56] References Cited

U.S. PATENT DOCUMENTS 2,184,908 12/1939 Chan ..... 165/6

2,819,881 1/1958 Sampietro ..... 165/4

*Primary Examiner*—Jr. Davis

*Attorney, Agent, or Firm*—Kerkam, Stowell, Kondracki & Clarke

[57] ABSTRACT

A heat transfer system comprising a pair of zones positioned at respective locations of differing temperatures between which heat is transferred; a first element, one surface of which conducts heat; a second element, one end of which communicates with one of the pair of zones and the other end of which communicates with the other of the pair of zones and one surface of which conducts heat and is slidably engaged with the heat-conducting surface of the first element and means for establishing oscillatory movement of the second element between the pair of zones such that the heat-conducting surface thereof slidably engages the heat-conducting surface of the first element and such that the ends thereof do not communicate with the other of the pair of zones.

1 Claim, 5 Drawing Sheets

HEAT TRANSFER SYSTEM WITHOUT MASS TRANSFER

This is a division of application Ser. No. 07/397,407 filed Aug. 23, 1989, now U.S. Pat. No. 5,004,041 issued April 2, 1991 which is a division of application Ser. No. 07/199,355 filed May 26, 1988, now U.S. Pat. No. 4,880,049 issued Nov. 14, 1989.

BACKGROUND OF THE INVENTION

1. Field of the Invention

The present invention relates to a system for transferring large quantities of heat without transfer of mass.

2. Description of the Prior Art

Diffusion has long been employed to separate molecules. Graham [On the law of diffusion of gases. Philosophical Magazine, Vol. 2, pp. 175–351 (1833)], who first related the molecular diffusion coefficient to the square root of molecular weight, separated gases based upon this principle in the 19th century. Hertz developed a technique based on diffusion to separate gases in a countercurrent system [Z. Physik., Vol. 19, p. 35 (1923); Z. Physik, Vol. 91, p. 810 (1934)].

This technique was extended to liquids by Lange [Z. Naturwiss., Vol. 16, p. 115 (1928); Vol. 17, p. 228 (1928)].

Dreyer et al [Die Steigerung des Diffusions-transportes durch Pulsations diffusion, Z. Naturforsch. Vol. 23, pp. 498–503 (1968); Die Bestimmung von Diffusionskoeffizienten nach der Pulsationsmethode, Z. Naturforsch. Vol. 24, pp. 883–886 (1969)] describe a system for determining the diffusion coefficients of solutes such as KCl, NaCl and $CaCl_2$ comprising two containers connected by a capillary and a mechanism for creating pulsating oscillations in the liquid contained in the capillary. Although the authors discovered an enhancement of transport by several orders of magnitude across the capillary, they do not describe or suggest utilization of the system to separate solutes contained in a common solvent.

Modified principles of diffusion are used industrially today, especially to separate isotopes of uranium. Diffusion has been used to separate solutes in liquid solution, however, the efficacy of the process is low because the molecular diffusion coefficient of solutes in liquids is about five orders of magnitude smaller than the diffusion coefficient of gases in a gaseous phase, thus reducing the possible yield for a given configuration.

Enhanced diffusion (or dispersion) by oscillatory motion of a fluid finds its roots in the theoretical work by Watson (J. Fluid. Mech., 133, p. 233 (1983) who himself expanded on a study by Taylor on the dispersion of solutes in steady laminar flow (Proc. R. Soc. London Ser. A 219, p. 186 (1953). Kurzweg et al recently described the conditions of optimal transport in gases by proper tuning of the experimental variables (Phys. Fluids, Vol. 29, p. 1324 (1986)).

The general principle involved may be described thusly: The oscillation of a fluid column in a tube generates a large surface between the oscillating core and the boundary layer which is essentially not moving. This surface is made available for diffusion. The theory predicts that, under certain conditions, the dispersion coefficient (i.e., the effective diffusion coefficient) is proportional to the square root of oscillation frequency, to the square of the average oscillation amplitude, and to the molecular diffusion coefficient. The diffusion rate (flux) of a solute in an oscillatory system is proportional to the dispersion coefficient, and to the concentration gradient and is dependent on geometry.

U.S. Pat. No. 4,590,993 describes a device for the transport of large conduction heat flux between two locations of differing temperature which includes a pair of fluid reservoirs for positioning at the respective locations connected by at least one duct, and preferably a plurality of ducts, having walls of a material which conducts heat. A heat transfer fluid, preferably a liquid, and preferably a liquid metal such as mercury, lithium or sodium, fills both reservoirs and the connecting ducts. An oscillatory axial movement or flow of working fluid is established within the ducts, with the extent of fluid movement being less than the duct length. Preferably the oscillatory movement is sinusoidal. Heat is transferred radially between the fluid and the duct walls and thence axially along the ducts. The rate of heat transfer is greatly enhanced by a physical mechanism which may be described as a high time-dependent radial temperature gradient produced by fluid oscillations. During most of each sinusoidal cycle, fluid in the wall-near region has a temperature different from the core of the fluid column, with most of the temperature difference concentrated across a relatively thin boundary layer.

U.S. Pat. No. 3,891,028 describes a regenerative heat-exchanger involving the use of a reciprocating piston containing holes to transfer the heat contained in hot exhaust gases of a combustion engine to the air taken in.

It is an object of the present invention to provide a heat-transfer system wherein the heat-transfer medium is a solid and there is substantially no net transfer of mass accompanying the transfer of heat.

SUMMARY OF THE INVENTION

The above and other objects are realized by the present invention which provides a heat-transfer system comprising:

- a pair of zones adapted for positioning at respective locations of differing temperatures between which it is desired to transfer heat;
- at least a first element, one surface of which comprises a material which conducts heat;
- at least a second element communicating with the pair of zones, one surface of which comprises a material which conducts heat and is slidably engaged with the heat-conducting surface of the at least first element; and
- means for establishing oscillatory movement of the at least second element between the pair of zones such that the heat-conducting surface thereof slidably engages the heat-conducting surface of the at least first element.

A further embodiment of the invention comprises a heat-transfer system comprising:

- at least a pair of zones constructed of heat-conductive material, each of the zones having a first surface adapted for positioning at respective locations of differing temperatures between which it is desired to transfer heat and each having a second surface adapted to slidably engage the exterior surface of a cylindrical element rotating about its longitudinal axis;
- a cylindrical element having at least the exterior surface thereof constructed of a heat-conductive material and being positioned such that the exterior surface thereof slidably engages the second surface of the zones when rotated about its longitudinal axis; and means for establishing rotation of the cylindrical element about its longitudinal axis.

A still further embodiment of the invention comprises a heat-transfer system comprising:

at least a pair of zones constructed of heat-conductive material, each of the zones having a first surface adapted for positioning at respective locations of differing temperatures between which it is desired to transfer heat and each having a second surface adapted to slidably engage the interior surface of a cylindrical element rotating about its longitudinal axis;

a cylindrical hollow element having at least the interior cylindrical surface thereof constructed of a heat-conductive material and being positioned such that the cylindrical interior surface thereof slidably engages the second surfaces of the zones when rotated about the longitudinal cylinder axis; and means for establishing rotation of the cylindrical element about the longitudinal axis of the cylinder.

DETAILED DESCRIPTION OF THE INVENTION

The present invention is predicated on the principles of heat conduction in solids slidably engaged with each other.

A preferred embodiment of the invention comprises a heat-transfer system as described above wherein:

the at least first element comprises a hollow cylinder, the interior wall of which comprises the heat-conducting material;

the at least second element comprises a piston-like member, the ends of which connect the containers and the exterior wall of which comprises the heat conducting material, the piston-like member being reciprocatable within the cylinder; and the means for establishing oscillatory movement being adapted to reciprocate the piston-like member axially within the cylinder with respect to the reservoirs.

An alternative preferred embodiment of the invention comprises a heat-transfer system as described above wherein:

the heat-conducting surface of the at least first element is planar;

the heat-conducting surface of the at least second element is planar, two ends of which connect the containers, the heat-conducting surface being slidably engaged with the heat-conducting planar surface of the at least first element; and the means for establishing oscillatory movement being adapted to axially slide the heat-conducting surface of the at least second surface with respect to the ends of the heat-conducting surface of the at least first element connecting the reservoirs.

A further preferred embodiment of the invention is as described above wherein:

the heat-conducting surface of the at least second element is a cylinder which rotates on its axis and which is slidably engaged with and between the two zones of different temperatures.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description, taken in conjunction with the drawings in which:

The present invention relates to a cooling device which does not require a coolant. It allows the transfer of large amounts of heat from an area of high temperature to an area of lower temperature without transfer of a substance which carries the heat. The mechanism is based on a heat transfer principle which is augmented by several orders of magnitude wherein the heat from the heat source is transferrd to a solid by conduction, then moving the solid a predetermined distance, and unloading the heat again by conduction.

Referring to FIG. 1, the system 10 consists of a solid piston 12 mounted within a cylinder 14. Piston and cylinder are constructed of a heat conducting material such as copper or aluminum. The piston which is typically about twice as long as the cylinder moves back and forth at a predetermined frequency and amplitude. Heat is applied by the heat source at one end of the piston and removed at the other end by the heat sink. Heat is transported from the hot end to the cool end by the several mechanisms described below.

Figure 2:
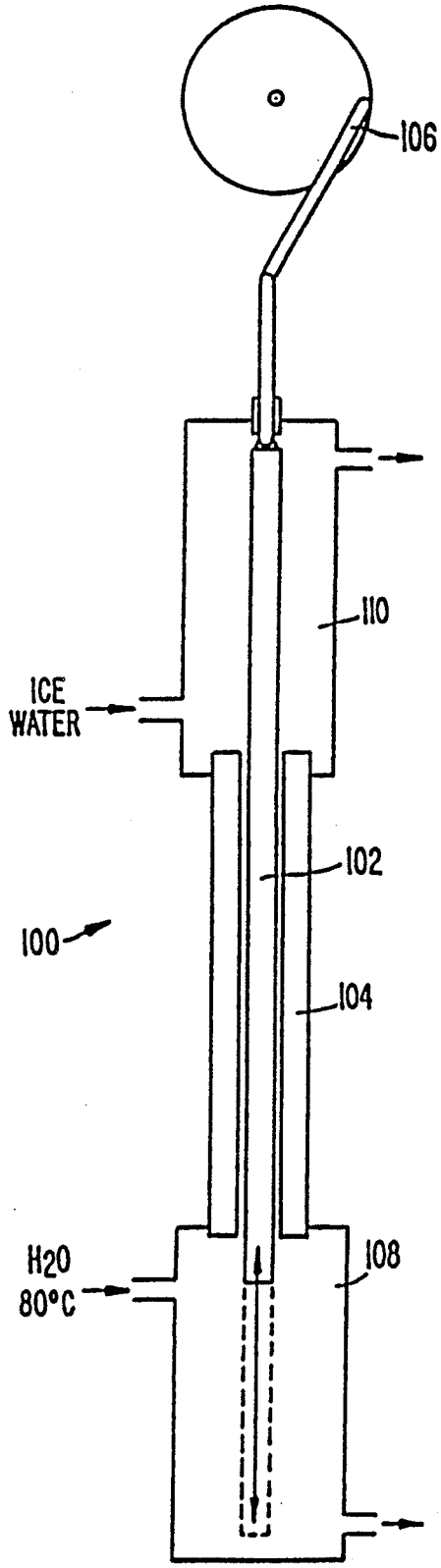
FIG. 2 is a similar elevational view of another form of the system.

Referring to FIG. 2, an experimental system 100 was set up with a 65 cm brass rod 102 of 0.62 cm diameter engineered to run smoothly, but tightly within a 32 cm brass cylinder 104 of approximately the same internal diameter (thickness: 0.1 cm). The piston was activated by an excenter 106. Two zones or reservoirs 108 and 110 were positioned at each end of the piston-cylinder combination. The reservoir 108 was typically circulated with one gallon of 80° C. water per minute from a constant temperature water bath. The reservoir 110 was typically circulated with cooler water at 100 to 200 ml/min.

Four series of experiments were run, three of which were controls.

The first control consisted of measuring the heat conduction of the system with the rod at rest. The heat was conducted from the heated reservoir 108 to the reservoir 110, which was circulated with room temperature distilled water. A heat flow of 18.1 cal/min was measured which compares with an estimated conductive heat flow of 15.8 cal/min. The difference is, presumably, dependent on measuring errors.

The second control estimated the heat produced by friction. The pump was activated at 4.7 and 10.6 Hz with strokes of 15.2, 20.3, 25.4, and 30.5 cm, respectively. A heat production varying between 30 and 114 cal/min was measured. Both frequency and stroke affected the heat production.

The third control determined the heat transport by the oscillating piston alone (the cylinder was removed). Ten experiments were performed, in which the frequency was varied between 2.2 and 10.6 Hz and the stroke between 15.2 and 25.4 cm. The heat transport ranged from 33 to 360 cal/min. There was no effect of frequency. Increased stroke caused a linear increase of heat transfer. The heat transfer was negligible when the stroke was less than 15.2 cm. (The heat transfer is best described by the following regression equation: heat transfer (in cal/min) = 25.6 stroke (in cm) − 381; correlation coefficient r = 0.83).

The total heat transfer was studied in a forth series of 12 separate experiments with frequency ranging from 2.2 to 10.6 Hz and stroke being varied between 15.2 and 30.5 cm. The reservoir 108 was maintained at 80° C., the reservoir 110 was perfused with ice water at 100 to 200 ml/min. The temperature of the water exiting reservoir 110 was carefully monitored and varied between 4° and 25° C. The total heat transfer varied between 511 and 3655 cal/min and is best described by a regression of the form:

$$\text{heat transfer (cal/min)} = 0.36\, f\Delta z^2 + 254;\ r = 0.85$$

where f is the frequency in Hz and $\Delta z$ the stroke in cm.

All of the above measurements were obtained at steady state, i.e., after the system had been allowed to run at the same conditions for ½ to 1 hour. Steady state was assumed to be established when the temperature measured with a thermocouple was constant for 5 minutes.

The piston-cylinder setup used in this series transports heat up to a rate of 3566 cal/min. This rate varies with frequency and the square of stroke amplitude. This represents a heat flow of up to 890 watt/cm$^2$. The transport occurs presumably, by several mechanisms:

The first mechanism is heat conduction through the 32 cm long piston-cylinder combination. It accounts in the experiment for 15–18 cal/min or 0.4% of the total heat transport.

The second mechanism is friction. It is not considered a transport, per se, but rather a side effect.

The third mechanism consists of the piston moving alternatively between the two reservoirs in such a way that parts of the heated rod get close to the heat sink without ever actually reaching it. This in effect shortens the distance of heat conduction between the reservoirs to just a few cm. This mechanism accounts for about 11% of the observed transport.

Figure 1A:
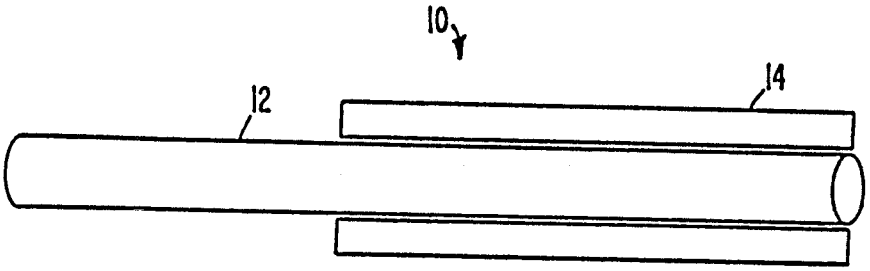
FIG. 1 is an elevational view of one form of heat transfer device in accordance with the invention.
Figure 1B:
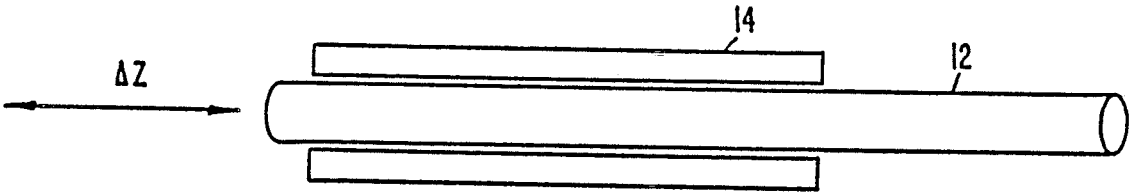
Figure 1C:
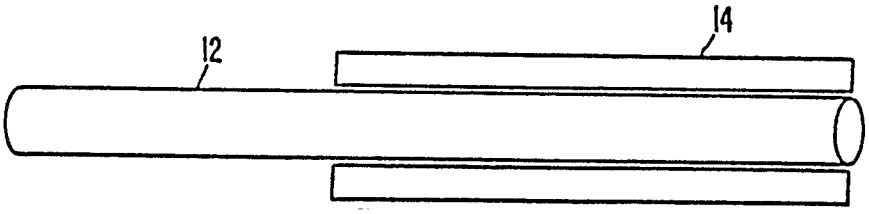

The last mechanism accounts for the majority of the heat transported (about 89%). This mechanism is related to the mechanism of enhanced diffusion in an oscillating fluid column discussed above. Its action may be described in four cycles as follows:

Piston 12 is initially heated by some heat source while in position a (cycle 1, FIG. 1*a*). The piston or rod then moves to the right position b (cycle 2, FIG. 1*b*); in this position the heated left half of the rod is now located within cylinder 14. Some of the heat of piston 12 is transferred by conduction from the rod 12 to the cylinder 14. The piston then moves back into position a (cycle 3, FIG. 1*c*). The left half of the rod moves back into the heat source while the cool, right half of the rod moves into the heated section of cylinder 14. Heat is now transferred from the cylinder to the right half of the rod. The fourth cycle of the mechanism consists of moving the rod again into position b. In that position the right half of the rod gives off heat to the heat sink.

It will be understood that the four cycles described above are a simplified, schematic way of analyzing the mechanism of this invention. In fact, heat is transferred continuously back and forth over the entire length of rod and cylinder, while the rod oscillates. This increases the surface of conduction of heat and also is analogous to the boundary layer effect mentioned above. Sinusoidal motion is the preferred, but not exclusive, mode of operation. At steady state, the temperature at any site of the inner surface of the cylinder varies with time above and below an average value. This average declines linearly along the inner surface of the cylinder from a high value close to the heat source to a low value close to the heat sink.

It will also be understood that heat diffuses into the rod and into the cylinder. The depth of penetration of the heat is dependent on how long heat is applied, i.e., it is dependent on frequency. It may be derived from classical work of heat conduction, that the penetration of the temperature fluctuations depends on heat conductivity K (in cm$^2$/sec), which is a material constant, and on oscillation frequency f (in Hz) according to:

$$\text{depth of heat penetration (in cm)} = \sqrt{K/\pi f}$$

In good heat conductors such as copper or aluminum, K approximates 1.0. For steel, the value of K is about 0.2 cm$^2$/sec. Thus, the heat penetration at 10 Hz using copper approximates about 0.2 cm, i.e., only a thin skin of metal participates in the heat exchanged between rod and cylinder. If the rod's radius is greater than the depth of heat penetration, the inner core is not part of the heat exchange. If the cylinder is thicker than the depth, its outer segment is also inactive. The system may be optimized by reducing the diameter of the rod and the thickness of the cylinder.

It will also be understood that the mechanism of this new process is based on heat conduction between two solids, one of which moves with respect to the other. Therefore, a good contact is essential to the optimal function of the system. This contact is obtained by proper engineering of the parts and, optionally, by lubrication of the slidably engaged surfaces with a heat-conducting lubricant such as water, mercury, graphite, etc.

Referring to FIG. 2, system 100 may also be used as follows: assume that a heat source (not shown) is applied to cylinder 104 and that reservoirs 108 and 110 are kept at a low temperature. System 100 then transports heat from cylinder 104 by way of piston 102 to the heat sinks 108 and 110.

Figure 3:
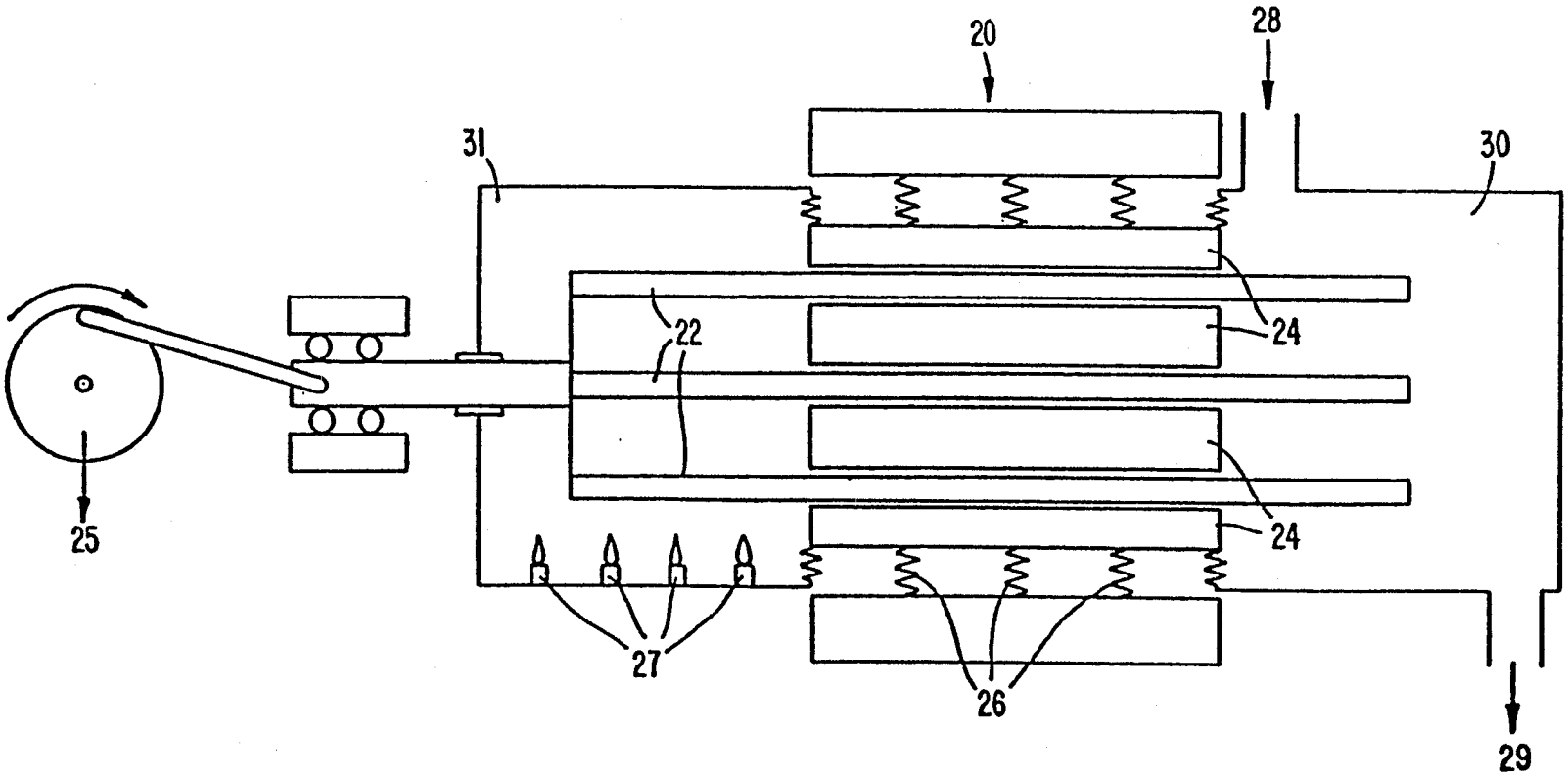
FIG. 3 is an elevational view of an alternative embodiment of the system of the invention.

FIG. 3 shows an alternative embodiment of the invention. The system 20 consists of a multiplicity of oscillating plates 22 sandwiched between stationary plates 24. All plates are made of heat-conducting material, preferably a metal such as copper, aluminum, or brass. The plates 22 are typically at least twice as long as plates 24, but have the same width. As an example, plates 24 would measure 100 cm by 100 cm; plates 22, 200 cm by 100 cm. Plates 22 move back and forth in an axial direction, driven by an excenter 25 or some other appropriate source of motion. The amplitude of motion is typically equal to the length of plates 24 (100 cm in our example). The frequency of motion is typically about 10 Hz. The thickness of the plates is dictated by considerations of optimization and is linked to the frequency; theoretically they could be made as thin as one-half centimeter if made of copper, but structural stability may require thicker plates and different materials. Springs 26 are adjusted to provide optimal contact between plates 22 and 24 without excessive friction. The plates 22 are exposed at one end to a heat source 27 in zone 31 which may be a furnace, a heated space, or a heat exchanger. At the other end, the plates are exposed to a heat zone 30 which may be a heat exchanger circulated by a gaseous or liquid coolant through ports 28 and 29. The difference between this system and that of FIGS. 1 and 2 is simplified geometry which allows for easier construction, easier maintenance, larger heat-exchange surfaces, and simpler control of the contact between moving and stationary parts. It should also be noted that if the amplitude of motion of plates 22 is smaller than the length of plates 24, no section of plates 22 exposed to the heat source is ever exposed to the heat sink, thus providing for a separation of heat source and heat sink.

Figure 4A:
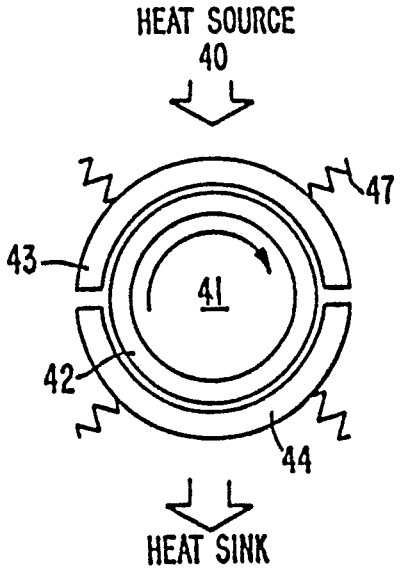
FIG. 4(*a*), (*b*) and (*c*) are elevational views of an alternative embodiment of the invention.
Figure 4B:
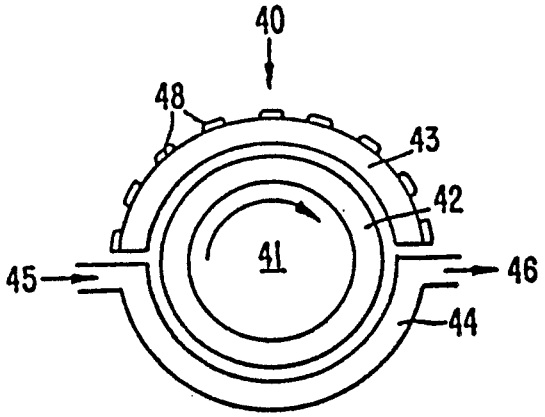
Figure 4C:
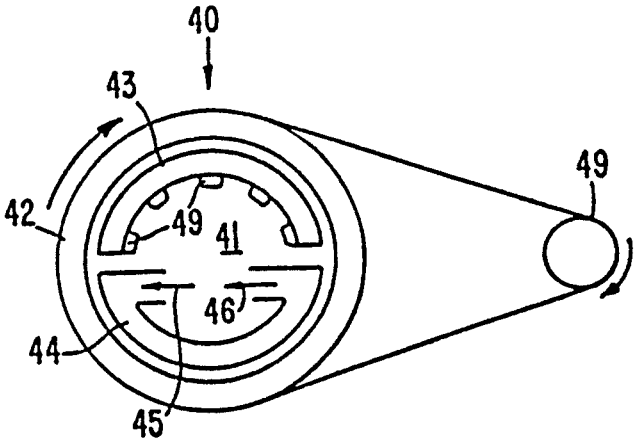

FIG. 4 shows a further alternative embodiment of the system of the invention. The main feature of this alternative is that the oscillatory motion of the rod/cylinder system and of the plate system is replaced by an energy-saving rotational system. FIG. 4 shows three variants of this embodiment of the invention.

FIG. 4(*a*) is a simplified schematic of the basic system. The system 40 consists of a cylinder 42 rotating on its longitudinal axis 41. It is enclosed by two stationary zones comprising half-shells of cylindrical shape engineered to provide tight contact with the cylinder with minimal friction. One half-shell 43 contains the heat source and cylinder 41 is heated by its contact. The other half-shell 44 is a heat sink and cylinder 42 is cooled by its contact. When cylinder 42 rotates, heat is transported from the heat source 43 to the heat sink 44. Preferably, all parts shown in FIG. 4(*a*) are made of heat-conducting material such as copper, aluminum, brass or some other heat-conducting material. The springs 47 are designed to optimize the contact between the half-shells 43 and 44 and the cylinder 42 and the heat conduction. The cylinder 42 has a radius varying typically between 10 and 30 cm. It may be solid or hollow. If hollow, its minimal thickness is about 0.5 cm, if made of copper. As clearly shown in FIG. 4(*a*), the exterior surface of cylinder 42 is a continuous, solid, cylindrical surface.

FIG. 4(*b*) shows a variant of this embodiment in which the heat source is represented by heat-producing computer components 48, such as microchips, which are fixed to the heat-conducting half-shell 43. The cooling is provided by a hollow half-shell 44 circulated by a coolant with an inlet 45 and outlet 46.

FIG. 4(*c*) shows a further variant of this embodiment in which the heat-producing components 49 are located inside half-shell 43 and heat sink 44 is provided with coolant inlet and outlet parts 45 and 46, respectively. Cylinder 42 provides for the heat transport. This variant provides for tighter packing of the computer elements to be cooled. Pulley 49 is employed to impart motion to the cylinder.

Figure 5A:
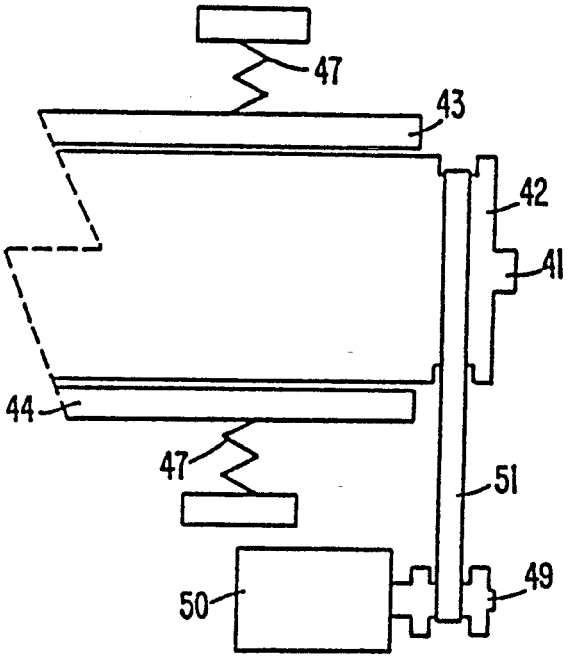
FIG. 5 is a side elevational view of the embodiments depicted in FIGS. 4(*a*) and 4(*b*).
Figure 5B:
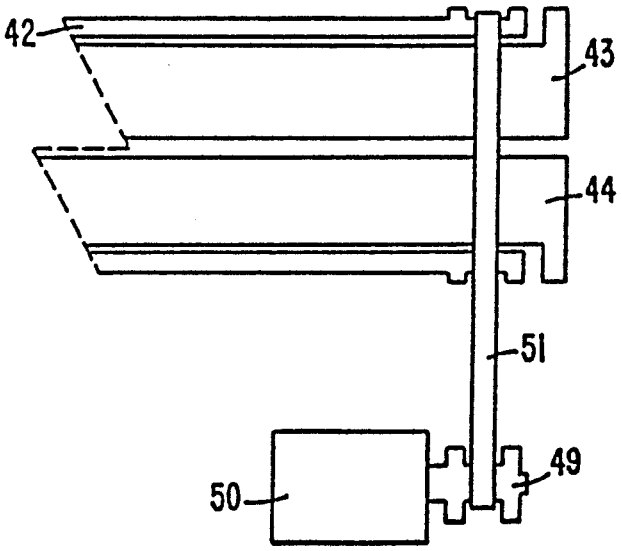

FIGS. 5(*a*) and 5(*b*) depict systems for driving cylinders 42 in the embodiments shown in FIGS. 4(*a*) and 4(*b*), respectively, consisting of drive motors 50 and drive belts 51 which attach to motors 50 via wheels 49.

The heat transport in systems such as the ones described above can be increased by increasing either the frequency or the stroke length. In addition, the process described above can be further optimized since the conduction of heat from the piston to the cylinder and reverse heats only a thin skin of metal.

These three factors may be explained thusly:

frequency f: It was found that the heat transfer increased with frequency (FIG. 2). The use of a fairly high frequency in the order of 10 Hz should, therefore, be used. The upper limit of frequency may depend on structural considerations, especially for the planar embodiment of the invention (FIG. 3). Another factor which may limit frequency is the efficiency of the heat transfer across structural gaps such as between the plates in FIG. 3.

amplitude $\Delta Z$: It was further found that the heat transfer increased with the square of oscillation amplitude. The increase of amplitude beyond the 30.5 cm value described above would increase the transfer notably.

optimization: One may reduce the thickness of the plates and of the cylinder used since heat penetrates only through a thin skin of the heat-conducting parts involved.

In the system of FIG. 2 a maximal transport of 3566 cal/min or 825 watts/cm$^2$ was achieved. This includes 114 cal/min of heat generated by friction. It is presumed that by reducing the diameter of the piston to 0.31 cm the heat transport could be increased to approximately 3600 watts/cm$^2$. In addition, it is presumed to be able to increase the heat transport approximately 10-fold by increasing the amplitude from 30.5 cm to 100 cm because of the square relationship between transport and amplitude. In the system of plates as shown in FIG. 3, one would predict a heat transport of about 2500 to 3000 Kwatt for three plates measuring 200×100 cm at a frequency of 10 Hz and an amplitude of 100 cm.

The heat transfer potential of the system of the invention is considerable. For efficient use, embodiments are employed utilizing multiple cylinders or plates.

The preferred heat-transfer system of the invention is one wherein the means for establishing oscillatory movement establishes sinusoidal motion. The heat conducting materials may be the same or different and are preferably metallic. The heat-conducting materials may be selected from the group consisting of aluminum, copper, zinc, silver and iron which have heat conductivities of 2.3, 3.8, 1.2, 4.2, and 0.7 watts/°Kcm, respectively, and alloys thereof.

It will be understood by those skilled in the art that the "zones" described herein may comprise reservoirs or any container of heated material, fluid (liquid or gas) or solid.

The various applications to which the system of the invention may be put will determine the choice of design. The system may be used to cool microchips when cooling by convection or by contact is insufficient. In this case a configuration such as the one shown in FIG. 4 may be useful. The system may have applications in space technology, where cooling by convection is at times difficult because of the lack of gravity. In this application, the fact that the heat source is hermetically sealed may be of use. The system may have applications in the cooling of conventional and nuclear furnaces. In the latter case, the fact that cooling is achieved without the transfer of a potentially radioactive coolant from the heat source to the heat sink is of great value. The system can provide an effective radioactive shield. The system may also be used to cool combustion engines.

It will be understood that the term "zone" is used herein in its broadest sense to define any bounded region or area set off as distinct from surrounding or adjoining parts and capable of functioning as a heat source or heat sink.

I claim:

1. A heat-transfer system comprising:

at least a pair of zones constructed of heat-conductive material, each of said zones having a first solid surface adapted for positioning at respective locations of differing temperatures between which it is desired to transfer heat and each having a second solid, continuous surface adapted to slidably engage the interior solid surface of a cylindrical element rotating about its longitudinal axis;

a cylindrically hollow element having at least the interior solid cylindrical surface thereof constructed of a heat-conductive material and being positioned such that the said interior solid cylindrical surface thereof slidably engages said second solid, continuous surfaces of said zones when rotated about the longitudinal axis of said cylinder; and means for establishing rotation of said element about the longitudinal axis of said cylinder.

* * * * *